US006126256A

United States Patent [19]

Doces, II

[11] Patent Number: 6,126,256

[45] **Date of Patent: *Oct. 3, 2000**

[54] PORTABLE STEMMED GLASS/CONTAINER RETENTION RACK AND SERVING TRAY

[76] Inventor: G. John Doces, II, 4432 55th Ave. NE., Seattle, Wash. 98105

[ * ] Notice: This patent issued on a continued prosecution application filed under 37 CFR 1.53(d), and is subject to the twenty year patent term provisions of 35 U.S.C. 154(a)(2).

[21] Appl. No.: 08/980,077

[22] Filed: Nov. 26, 1997

[51] Int. Cl.[7] ..... A47B 95/00

[52] U.S. Cl. ..... 312/351; 312/290; 211/74; 211/71.01

[58] Field of Search ..... 312/351, 244, 312/350, 351.8, 128, 206, 207, 282, 311, 317.3; 211/74, 71.01, 78, 60.1; 248/311.3, 314; 108/25, 28; D6/467, 466, 469; D7/701, 703; D24/227, 229

[56] References Cited

U.S. PATENT DOCUMENTS

| | | | |
|---|---|---|---|
| D. 168,307 | 12/1952 | Lenard | D74/13 |
| D. 234,658 | 4/1975 | Tillinger | D6/157 |
| D. 267,744 | 1/1983 | Flynn | D24/229 |
| 285,386 | 9/1883 | Burton | 211/74 |
| D. 301,670 | 6/1989 | Kennedy | D7/71 |
| D. 333,523 | 2/1993 | Gianino | D6/467 X |
| 593,312 | 11/1897 | Schandein et al. | 211/74 |
| 701,401 | 6/1902 | Schrader | 312/290 X |
| 1,659,344 | 2/1928 | Wissman | 294/143 |
| 1,730,345 | 10/1929 | Berman | 211/74 |
| 1,913,033 | 6/1933 | Kwapil | 211/74 |
| 1,996,300 | 4/1935 | Lindsey | 294/143 |
| 2,080,865 | 5/1937 | Lassiter | 211/74 |
| 2,107,744 | 2/1938 | Solomon | 211/74 |
| 2,142,019 | 12/1938 | Warner | 248/312 |
| 2,371,433 | 3/1945 | Davis | 211/60 |
| 2,540,392 | 2/1951 | Haskell | 294/144 |
| 2,678,864 | 2/1954 | Louis | 312/272.5 |
| 2,725,274 | 11/1955 | Stivale | 312/282 X |
| 2,899,079 | 8/1959 | Davis | 248/311.3 X |
| 2,906,412 | 9/1959 | Tanner | 211/74 |
| 3,013,852 | 12/1961 | Rockola | 312/321.5 X |
| 3,039,616 | 6/1962 | Proffit | 211/74 |
| 3,171,544 | 3/1965 | Unsworth | 211/71 |
| 3,217,891 | 11/1965 | Weaver | 211/74 |
| 3,491,893 | 1/1970 | Morris | 211/60 |
| 4,077,593 | 3/1978 | Carratala et al. | 312/351 X |
| 4,266,835 | 5/1981 | Schmidt | 312/244 |
| 4,334,623 | 6/1982 | Geary | 211/71 |
| 4,546,883 | 10/1985 | Youngdale | 211/74 |
| 4,625,655 | 12/1986 | Brickman | 108/25 |
| 4,669,790 | 6/1987 | Briggs | 312/293.2 X |
| 4,700,849 | 10/1987 | Wagner | 211/71 |
| 4,842,350 | 6/1989 | Collings | 312/228 |
| 4,947,991 | 8/1990 | Snell | 206/427 |
| 5,704,495 | 1/1998 | Bale et al. | 211/71.01 |

FOREIGN PATENT DOCUMENTS

| | | | |
|---|---|---|---|
| 1127343 | 8/1956 | France | 211/74 |
| 12651 | of 1893 | United Kingdom | 271/74 |
| 8986 | of 1894 | United Kingdom | 211/75 |
| 8662 | 4/1896 | United Kingdom | 211/74 |
| 418729 | 10/1934 | United Kingdom | 211/74 |
| 2244205 | 11/1991 | United Kingdom | 211/74 |

*Primary Examiner*—Peter M. Cuomo
*Assistant Examiner*—James O. Hansen
*Attorney, Agent, or Firm*—Dowrey & Associates

[57] ABSTRACT

A storage rack for stemmed glasses and other containers having apertures with chamfered edges forming sockets for reception of the bases of inverted stemmed glasses. Access slots to the apertures are non radial with respect to the center of the apertures and are preferably tangential to the apertures. A pivotally mounted serving/mixing tray overlies the bases of the stemmed glasses to positively hold them within their sockets with positive holddowns or keeper members positioned to maintain the tray top in place. The rack may be wall mounted or adapted to be supported on a table top or the like and may be provided with carrying handles. In one embodiment, the storage rack is combined with a wine bottle rack having a cradle comprised of wedge shaped support members with contact surfaces inclined at less than 45° to the vertical. The bottles are thus supported above the surface of the shelf and the weight of the bottles themselves holds the them in tight engagement within the cradle. When combined with a portable sink and/or ice makers the bar unit becomes a self-contained installation for home, office, boat or RV use.

25 Claims, 5 Drawing Sheets

FIG. 2
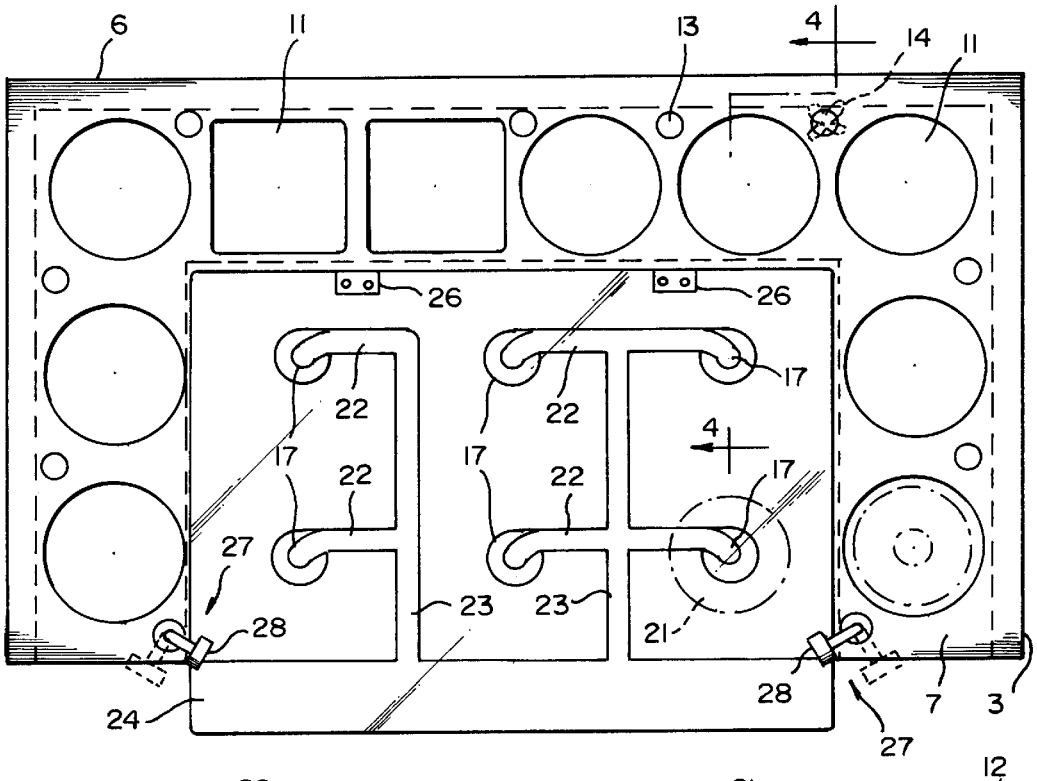
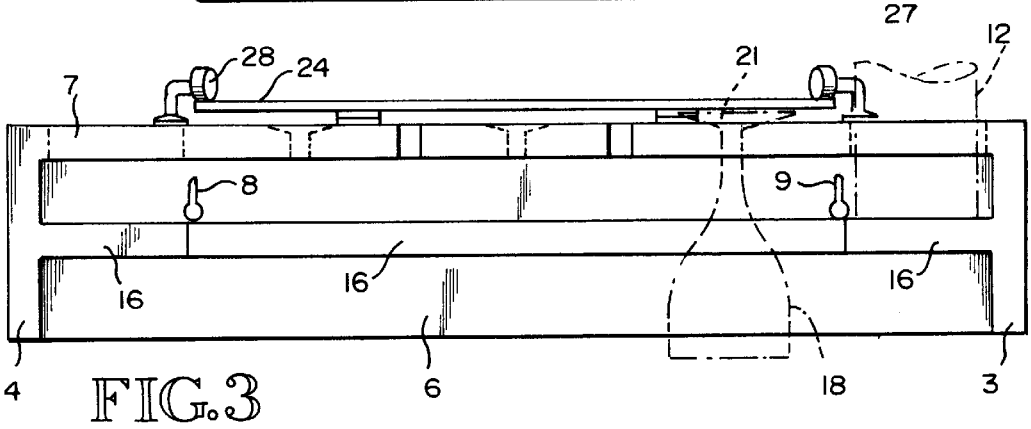
FIG. 3
FIG. 4
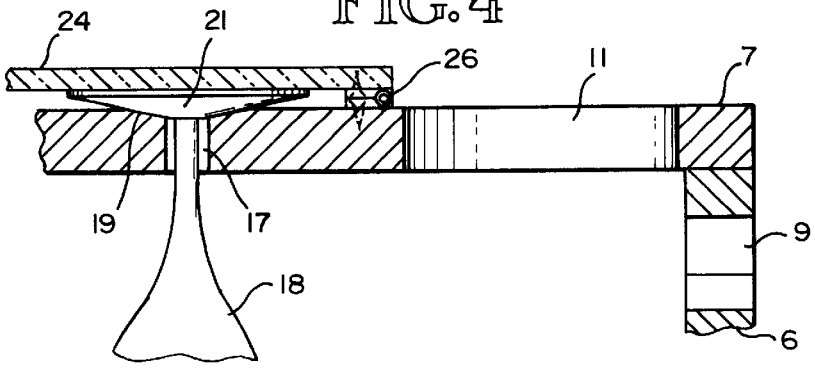
FIG. 5
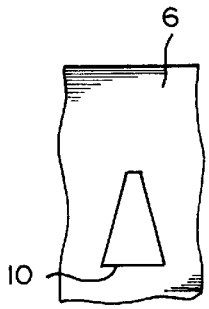

PORTABLE STEMMED GLASS/CONTAINER RETENTION RACK AND SERVING TRAY

BACKGROUND OF THE INVENTION

1. Field of the Invention

The present invention relates to a portable rack for storing stemmed vessels such as glassware and other containers including beverage bottles in, environments such as boats and road vehicles subject to erratic motion or vibrations. More particularly, the present invention provides a glassware rack of the character described wherein individual stemmed vessels are retained against impact with one another and/or dislodgement from the rack under adverse conditions such as experienced in small craft navigating rough water or recreational vehicles traveling on rough road surfaces. The rack of the present invention also embodies combined features which particularly adapt the rack to be either wall mounted or used as a self-contained bar unit or serving tray on a support surface.

2. Description of the Prior Art

Numerous rack designs of both the wall-hanging and self-supporting type have been developed in the prior art for storing and supporting stemmed glassware and wine bottles or beverage containers. One common structure is that described in the Wagner U.S. Pat. No. 4,700,849 which comprises an overhead wine bottle rack with an arrangement of rails or slots for supporting stemmed wine glasses in the inverted position. U.S. Design Pat. No. Des. 301,670 to Kennedy illustrates another type of stemmed glass storage unit wherein the glasses are inverted and the stem and base are held in a circular opening made accessible by a radial slot. UK Patent Application No. 2244205A and French Patent No. 1,127,343 show still further examples of devices for storing stemmed glassware and wine bottles utilizing a wire rack design. With the type of support structures described in these patents, the common problem is that the inverted stemmed ware is allowed to hang free, subject to possible damaging contact with one another if the support rack is jostled or impacted in any manner. The result, of course, is broken stemmed ware. Additionally, the slotted support arrangements, either the rail type as shown in U.S. Pat. No. 4,700,849 or the radial slot type shown in the other patents, provide no means to prevent accidental dislodging of the stemmed glassware if the unit is tilted or jarred.

In order to provide a more stable seating for the inverted stemmed ware, many wine glass racks utilize a socket or chamfered edge around the circular hole which holds the base of the stemmed glass. The following listed patents show examples of this

| U.S. Patent No. | Patentee |
|---|---|
| 3,491,893 | Morris |
| 4,546,883 | Youngdale |
| Foreign Patent | |
| UK8986 | Morrison et al |

The chamfered opening configuration adds a certain amount of stability to the inverted stemware and improves the seating of the base of the glass against the retention opening. The use of radial slots providing access to the openings in the holder, however, permits accidental removal of the stemmed ware from the slots. While the Youngdale U.S. Pat. No. 4,546,883 provides individual enclosures or dividers between the inverted stemmed ware for shipping purposes, during normal use the glasses are allowed to freely swing with the possibility of breakage. The British Patent No. 8986 seeks to solve the problem by providing a second set of openings c which surround the glasses to prevent contact.

Another attempt at stabilizing the base-held stemmed glass units in a rack is shown in the Unsworth U.S. Pat. No. 3,171,544. This concept involves the use of a slot for admitting the base of the stemmed glass and a cushion like substance with a backup film layer which bears against the bottoms of the individual glasses to hold them in place. This approach however does not serve to isolate the glasses and prevent damaging contact in the event of any rough handling of the rack.

The following listed patents are offered as examples of serving tray structures which are designed to hold food and beverage glasses and/or containers:

| U.S. Patent No. | Patentee |
|---|---|
| 285,386 | Burton |
| 1,996,300 | Lindsay |
| 2,080,865 | Lassiter |
| 2,540,392 | Haskell |
| 4,947,991 | Snell |

U.S. Pat. No. 1,996,300 to Lindsay and U.S. Pat. No. 2,540,392 to Haskell show devices for securing food or beverage containers to the tray structure in a storage mode. None of these devices, however, are designed for hanging inverted stemmed glassware.

None of the prior art patents discussed address the problem of stabilizing inverted stemmed glassware in an environment, such as mobile campers and trailers or marine vessels, wherein the rack is likely to be frequently jostled or tilted. In this environment, the stemmed glasses not only swing and contact each other causing breakage but are susceptible to being jarred out of their retention sockets because of the open radial access slots.

SUMMARY OF THE INVENTION

The present invention provides an improved storage rack for stemmed glass and other beverage containers which may be either wall mounted or table top supported. In one embodiment, the rack structure of the present invention provides a novel configuration of tangentially disposed access slots for the stemmed glass retention sockets. This feature alone adds stability and lessens the possibility of accidental removal of the stemmed vessels. Additionally a pivoted cover panel may be mounted on the rack structure so as to overlie the bases of the glasses in the sockets. The inverted stemmed glasses are thus further stabilized so as to prevent relative movement and possible damaging contact. The pivoted cover panel also serves as a tray surface permitting the glass/container rack to be used as a serving tray for beverages or foodstuffs. One embodiment of the rack structure is made suitable for a self-contained bar unit with the inclusion of a wine rack. The wine rack includes novel support means wherein the bottle as well as its neck portion is tightly held in a cradle. The weight of the bottle itself serves to wedge it in the supports, secure against removal by the usual jarring, tilting or vibrations experience in the type of environment described.

BRIEF DESCRIPTION OF THE DRAWINGS

FIG. 2 is a plan view of the rack and serving tray of FIG. 1;

FIG. 3 is a front elevational view of the rack and serving tray;

FIG. 4 is a cross sectional view taken along lines 4—4 of FIG. 2;

FIG. 5 is an elevational detail of a modified slot arrangement for wall mounting the rack;

DESCRIPTION OF THE PREFERRED EMBODIMENT

While the present invention is illustrated as a portable rack with particular utility in recreational vehicles or marine vessels subject to severe vibrations or severe buffeting, it will be understood that the invention is not in any way limited to these usages. For instance, the rack and serving tray combination can be installed as a permanent fixture and is well adapted for home or commercial use such as restaurants and bars. The novel retention socket and access slot configuration may also be used in stemmed glass support racks of various configurations either with or without an overlying tray top.

Figure 1:
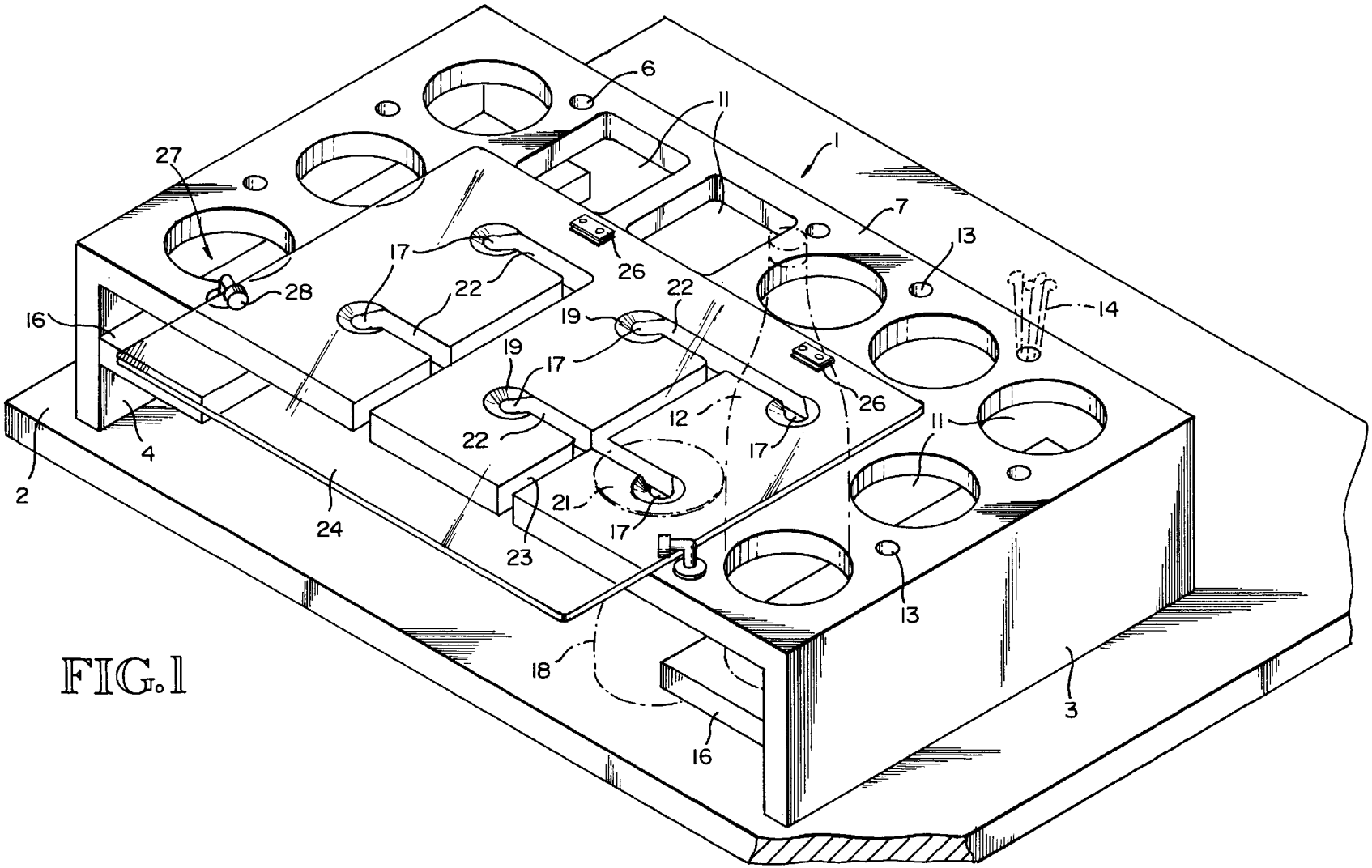
FIG. 1 is a perspective view of the portable stemmed glass container rack and serving tray positioned on a supporting surface.

FIGS. 1–5 illustrate a preferred embodiment of the invention comprising a portable unit which may be wall mounted for storage and removed for use on a table top or other support surface for serving beverages. Referring to FIG. 1, the support rack indicated generally at 1 is shown supported by a table top or other support surface 2, convenient for serving beverages or the like. The portable rack includes vertical end panels 3 and 4, a vertical rear panel 6 and a stemmed glass/container support top horizontal panel 7. The structure described forms a box like unit which may be supported on a table such as shown in FIG. 1 with the rear and end panels supporting the top panel 7 above the table surface. The forward edge of the panel 7 presents a free edge for access to the vessel retention structures presently to be described. The rear panel 6 may be provided with spaced slotted openings 8 and 9, shown in FIGS. 3 and 4, for the purpose of mounting the tray structure on a vertical wall in a well known manner. The vertical and horizontal panels of the rack may be constructed from any suitable material such as wood, plastic or metal in order to provide a rigid structure.

As seen in FIG. 1, the top horizontal panel 7 in the preferred embodiment includes a plurality of openings 11 around the rear and side peripheral edges which may be of various sizes and configurations to conveniently receive and support items such as square or round bottles 12, drinking glasses or food containers as the case may be. In addition, holes of a smaller dimension such as shown at 13 may be provided around the periphery for receiving such items as straws or swizzle sticks 14. In order to accommodate items stored in the holes 11 and 13, a horizontal ledge 16 is attached to the inside surfaces of side panels 3 and 4 and rear panel 6. The ledge thus extends about three sides of the rack structure directly beneath the holes 11 and 13 and is spaced an appropriate vertical distance in order to provide support for items contained in the openings. The ledge 16 may be constructed in any desired design but will preferably be made from the same material as the rest of the rack and supported directly from the rear and end panels in a rigid manner. With this construction, the central area of the top panel 7 remains clear for the purpose of preparing and serving food or beverages.

As seen in FIGS. 1 and 2, the central and forward area of the horizontal panel 7 is provided with a plurality of holes or apertures 17 which extend through the body of the panel. The apertures may be identical or of varying sizes but, in any case, each is designed to receive the stem of the particular stemmed glass 18 to be stored in the inverted position as shown in FIGS. 1, 3 and 4. It will also be noted that, although six such apertures are illustrated in the preferred embodiment, the exact number of storage locations and the particular pattern or arrangement of the apertures may be varied without departing from the spirit of the present invention. Each of the apertures 17 is provided with a chamfered edge 19 on the upper surface of the panel 7. The chamfered edges provide a dish-like reception area or socket for the normally tapered surface of the stemmed glass base 21 indicated in FIGS. 3 and 4. Although the chamfered edge and the socket provided acts to somewhat stabilize the hanging glass, it does not prevent swinging motion of the glasses in the event the rack is tilted or jarred. In practice, the diameter of the chamfered edge and socket may be varied to accommodate any specific stemmed glass base.

Each of the apertures 17 is also provided with an associated access slot 22 which may be of approximately the same width as the diameter of the aperture 17 so as to allow passage of the glass stems. The slots 22 are positioned so as to be non-radial with respect to the circular holes 17. It is preferable to locate one side of the slot 22 substantially tangential to the aperture 17. The other side may be tangential with the circular periphery of the chamfered edge 19 depending of course on the diameter of the chamfered edge. With this arrangement, simply tilting the rack in the direction of the access slots will not dislodge the glass stems as would otherwise be the case if the slots are made radial with respect to the holes. This feature alone adds stability to the vessels. The chamfered sockets 19, of course, have a tendency to hold the glass base against removal simply because the diameter of the dished area or socket is greater than the diameter of the associated aperture. If the access slot is positioned radially with respect to the aperture, however, any vertical jarring will raise the glass base out of the socket allowing the stem to slide out of the access slot. With the use of the non radial access slots of the present invention, it will be seen that it would take a compound motion of the glass stem in order to dislodge it from the aperture. The rack would not only have to be tilted but the glass base would have to be elevated out of the socket and then moved laterally in order to pass out of the access slot. In addition to the unlikelihood of jarring the stemmed glasses from the apertures and the slots 22, each of the slots 22 in the present embodiment opens into a feeder slot 23 rather than to the open front or free edge of the panel 7. Accidental removal of the stemmed glass form the rack would therefor require a tilting of the rack, a lifting of the glass from the retention socket and movement in at least three different directions in order to be dislodged.

According to the present invention, an even more positive means for holding the inverted stemmed glasses in their sockets under the most severe jostling, tilting or mechanical vibrations is provided. For this purpose, a hinged serving tray top 24 is mounted on the horizontal panel 7 and overlies all of the retention sockets 19. The tray top 24 may be varied in size but preferably occupies substantially the entire central area of the panel 7 except for the storage openings 11. The tray top 24 may be hinged as at 26 in any conventional manner so as to allow sufficient clearance to rest on top of the glass bases 21 when in the lowered position as shown most clearly in FIG. 4. The tray top 24 may thus be raised to allow removal of the stemmed glasses 18 and lowered to positively hold the glass bases in their respective sockets. The tray top 24 may be extended a short distance beyond the front or free edge of the panel 7 for ease of operation and pivoted stop members or keepers 27 may be used to positively hold the tray top in the lowered position. As seen in FIG. 2, the stop members include a pivot post with a contact element 28 carried by the outer end for contacting the tray. The elements 28 may comprise a resilient material to avoid marring the tray surface. As shown in FIG. 2, the keepers may be pivoted between a position overlying the edges of the tray and a release position to allow raising of the tray. Although the serving tray 24 is illustrated as a transparent panel such as glass or plastic, in the alternative, it may be made from any suitable material and may be varied in shape and design for aesthetic purposes. In any event, when the tray top 24 is lowered and held in position by the keepers 27, the stemmed glasses 18 are positively held in position eliminating any danger of swinging and contacting one another or being jarred out of their sockets.

FIG. 5 illustrates an alternate slotting arrangement for mounting the rack to a wall surface. In the FIG. 5 embodiment the opening in the rear panel 6 is essentially triangular in shape having one side of the triangle forming the broad base 10 with the apex of the triangle located at the top. It will be understood that the alternate wall attaching opening of FIG. 5 functions in a conventional manner as is true with the slotted openings 8 and 9 shown in FIGS. 3 and 4.

Figure 6:
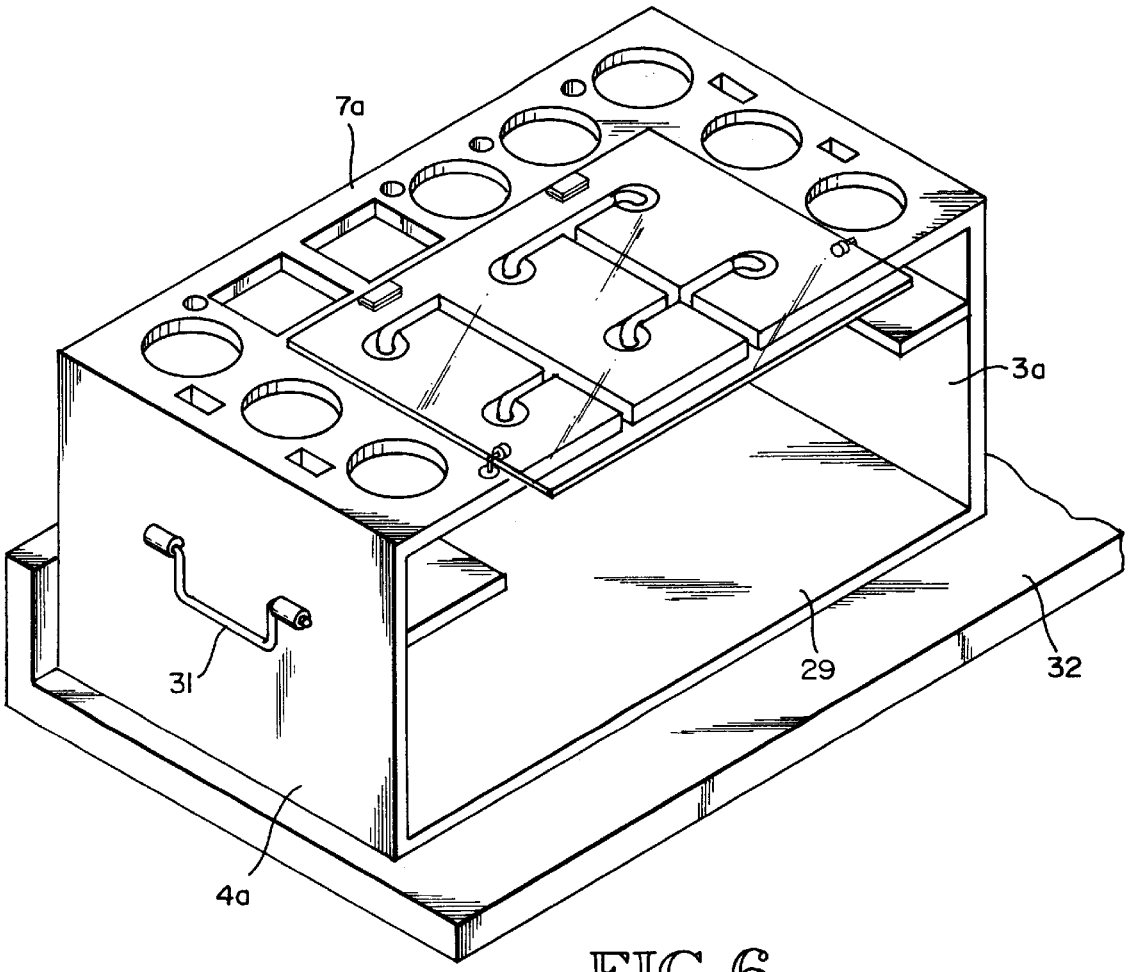
FIG. 6 is a perspective view showing a modification of the rack and serving tray adapted for counter top storage with carrying handles.
Figure 7:
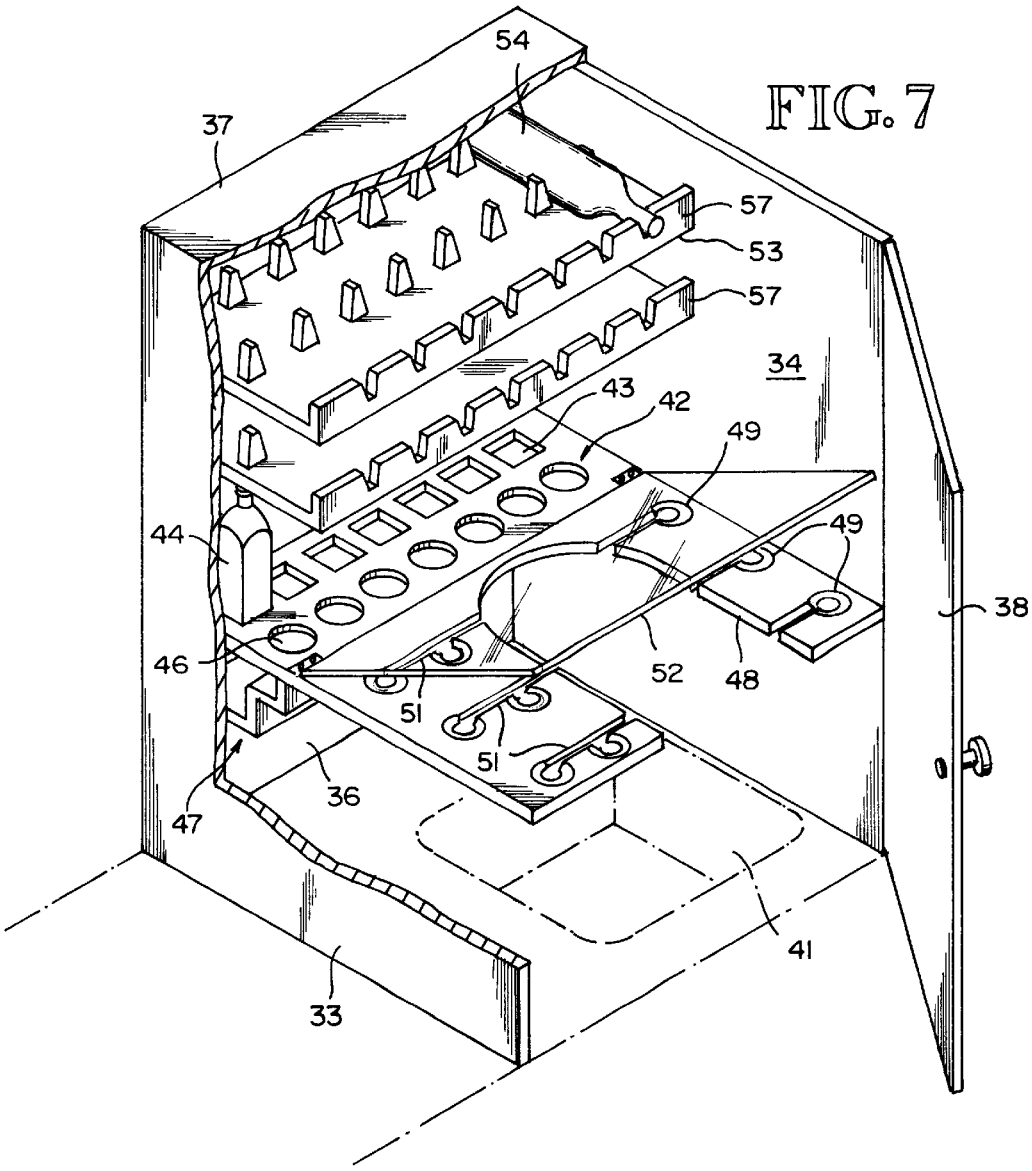
FIG. 7 is a perspective view of a modification of the rack and tray with a wine storage unit.

FIG. 6 illustrates a modification of the combined rack and serving tray suitable for shelf or table top storage rather than wall mounting. It will be understood that the pivoted tray top and stemmed glass retention features described for the FIG. 1 embodiment also apply to the modified structure of FIG. 6. As illustrated, the side walls 3*a* and 4*a* as well as the rear panel of the rack are extended to provide additional space beneath the horizontal top panel 7*a*. The structure is also provided with a bottom panel 29 so that additional items may be stored and carried in the rack beneath the tray top. Carrying handles 31 of any conventional design may also be mounted on the side panels 3*a* and 4*a* for carrying the rack. The modified rack and serving tray may be conveniently stored on a shelf or other supporting surface 32 and moved to any location for serving.

FIGS. 7–10 illustrate a further embodiment of the invention wherein the stemmed glass rack is combined with a service tray and a novel wine bottle storage structure. The combined units may be housed in a rectangular cabinet structure having side panels 33 and 34, a rear panel 36 and top wall 37. The cabinet thus assembled may be provided with a lockable door or doors 38 as illustrated to secure the contents of the cabinet. The bottom of the cabinet remains open, however, for the purpose of utilizing a conventional countertop sink such as shown at 41. The sink 41 may be an existing home, office or recreational vehicle sink as the case may be. A container storage and mixing shelf 42 is located within the cabinet structure and carried by the side and rear panels of the cabinet. The shelf 42 will be positioned at a level within the cabinet so as to leave room beneath for access to the sink 41. The shelf 42 includes a plurality of openings 43 along its rear edge for upright placement of such items as beverage bottles 44, either square or round, and an adjacent row of circular openings 46 which may be utilized for drinking glasses or tumblers. In order to support the bottles and glasses from beneath, a stepped shelf 47 extends between the walls 33 and 34 and may be supported from the bottom of the shelf 42 and the back wall 36.

The forward portion of the shelf 42 is provided with, in this case, a u-shaped cut-out area indicated at 48 which may be located so as to provide access for removal of stemmed glasses and use of the sink 41. A plurality of stemmed glass retention structures are located on the surface of the shelf 42 about the central cut-out 48. In the present embodiment, three such glass retention structures 49 are shown on one side of the shelf while three sets of tandem support structures 51 are shown on the opposite side. These structures may be similar or identical to the retention structures shown in the FIGS. 1 and 2 embodiment and will include apertures in the shelf for the reception of glass stems, chamfered sockets about the apertures and tangential access slots. In this embodiment the access slots open into the cut-out area 48. A pivoted tray top 52 is hinge mounted on the top surface of the shelf 42 in the same manner as described for the serving tray top 24 of the FIG. 1 embodiment. In this embodiment, the pivoted tray 52 is used for mixing or pouring drinks.

Figure 8:
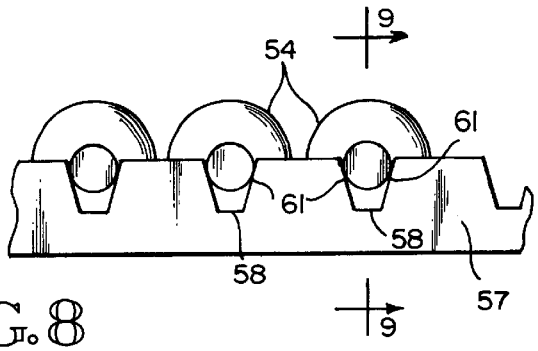
FIG. 8 is a front elevational detail of a portion of the wine bottle storage unit.
Figure 9:
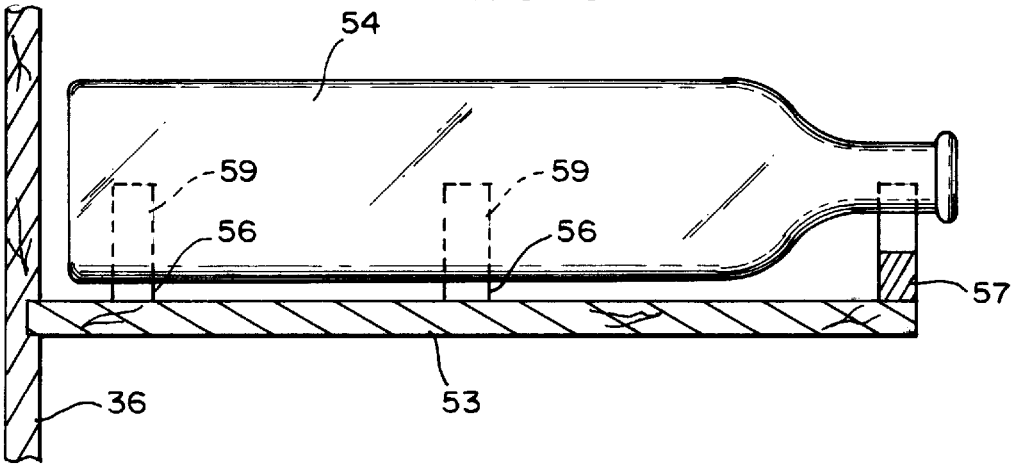
FIG. 9 is a cross sectional view taken along lines 9—9 of FIG. 8.

One or more wine or other beverage bottle storage shelves 53 are mounted between the side panels 33 and 34 directly above the storage shelf 42 and located to the rear of the cabinet. These shelves may be identical with the number of shelves utilized being a matter of choice. Each shelf 53 is designed to store a plurality of bottles 54 in parallel substantially horizontal position. In the present illustrated embodiment individual wine bottles are cradled in their storage position by means of a pair of longitudinally spaced wedge shaped supports 56 on each side. The neck of the bottle is supported by a front rail 57 attached to the forward edge of the associated shelf 53. Wedge shaped notches or slots 58 are formed in the top edge of the rail and designed to receive the neck of the bottle as shown in FIG. 8. According to the present invention the wine bottles are suspended above the shelf 53 and the necks of the bottles do not contact the bottom of the associated notches 58 in the rail 57. The pairs of wedge-shaped supports 56 have opposing inclined faces 59 which do not permit the bottle to contact the underlying shelf 53. The angles of the inclined surfaces 59 are chosen so that the bottle is actually wedged between the supports by its own weight. In order to accomplish this, the surfaces 59 are preferably inclined at an angle less than 45° to the vertical. Likewise, the opposing inclined surfaces 61 of the notches 58 are inclined at an angle less than 45° to the vertical so as to actually wedge the neck of the bottle above the bottom of the notch. This arrangement serves to hold the bottles tight in their cradles with total support being provided by the supports 56 and notches 58. Thus, the likelihood of dislodgement of the bottles is avoided if the cabinet is moved or is utilized under circumstances where jostling or vibrations are encountered.

Figure 10:
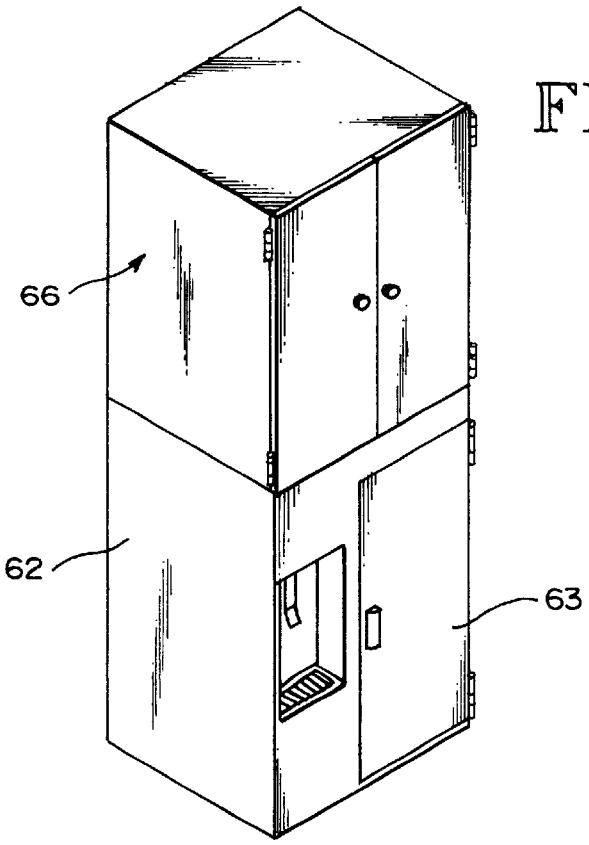
FIG. 10 is a perspective view of the FIG. 7 embodiment combined with a self-contained sink and ice maker.

The bar unit of the type described may be utilized with an existing sink or be combined with other features such as a self-contained sink or ice maker as shown in FIG. 10. The FIG. 10 embodiment shows a double-doored storage rack and mixing tray 66 which may in all respects be identical to the FIG. 7 embodiment mounted integral with or detachable from an ice maker 62 and a wet or dry sink 63. Installations of this type are convenient for use in large yachts or cross country RVS and especially adaptable for office environments.

It will be understood that the foregoing description and accompanying drawings have been given by way of illustration and example. It is also to be understood that changes in form of the several parts, substitution of equivalent elements, arrangement of parts, and substitution of equipment materials, which will be readily apparent to one skilled in the art, are contemplated as being within the scope of the present invention, which is limited only to the claims which follow.

What is claimed is:

1. In a stemmed vessel retention rack having a support surface, a vessel support structure comprising;

at least one aperture in said support surface having a center point and a chamfered peripheral edge forming a socket for reception of a surface of a vessel having its stem extending through said aperture, a non radial aperture access slot communicating with said aperture for permitting lateral insertion of a vessel stem into said aperture, the slot and the aperture meeting at a junction, the slot having substantially parallel side edges and a centerline offset from the center point of said aperture at the junction thereof, a tray panel pivotally mounted on said support surface for movement between a lowered position overlying the base of the vessel for positive retention of said vessel and a raised position allowing access for removal thereof, and a a keeper mechanism for positively holding said tray panel in the lowered position.

2. The support structure of claim 1 wherein the side edges of said slot are spaced in the same direction from a line parallel thereto and passing through the centerline of the aperture.

3. The support structure of claim 2 wherein said aperture and said chamfered edge are circular and one side edge of said slot is substantially tangent to said aperture.

4. The support structure of claim 3 wherein said socket is configured to receive a surface of a base of an inverted stemmed vessel.

5. The support structure of claim 3 wherein said slot has a second side edge, said second side edge of the slot being substantially tangent to the outside periphery of said chamfered edge.

6. The support structure of claim 5 wherein the width of said slot is approximately equal to the diameter of the aperture.

7. A vessel retention rack comprising;

a substantially planar panel having a top support surface, at least one aperture in said panel adapted to contain a vessel stem, said aperture having a center point and a chamfered peripheral edge in the support surface forming a socket for reception of a surface of a vessel having its stem extending through said aperture, a non radial access slot in said panel communicating with said aperture to permit lateral insertion of a vessel stem therein, the slot and the aperture meeting at a junction, the slot having substantially parallel side edges and a centerline offset from the center point of said aperture at the junction thereof, a tray panel pivotally mounted on said top support surface for movement between a lowered position overlying the base of the vessel for positive retention of said vessel and a raised position allowing access for removal thereof, and a a keeper mechanism for positively holding said tray panel in the lowered position.

8. The retention rack of claim 7, wherein said chamfered edge is circular and one side of said slot is substantially tangent to said aperture.

9. The retention rack of claim 8 wherein said socket is configured to receive a surface of a base of an inverted stemmed vessel.

10. The retention rack of claim 7 wherein said support surface has at least one free edge for vessel insertion, said rack further including;

a plurality of said apertures and associated access slots in spaced relation in said support surface, and at least one feeder slot in said panel opening into said free edge, each said access slot opening into said feeder slot.

11. A stemmed vessel retention rack comprising;

a substantially planar panel having a top support surface having at least one substantially linear free edge for vessel insertion, a plurality of apertures in said panel, each aperture adapted to contain a vessel stem, said aperture having a center point and a circular chamfered peripheral edge in the support surface forming a socket for reception of a surface of a vessel having its stem extending through said aperture, a plurality of access slots in said panel in spaced relation with said slots intersecting said apertures to permit lateral insertion of a vessel stem therein, the slots each having a longitudinal axis offset from the center point of its associated aperture and a side that is substantially tangent to said aperture, at least one feeder slot in said panel opening into said free edge at right angles thereto, each said access slot opening into said feeder slot at right angles thereto.

12. The retention rack of claim 4, wherein said plurality of apertures and associated access slots and feeder slot comprise a set of vessel support structures, said support surface including a plurality of said sets of vessel support structures.

13. A combination serving tray and storage rack for storing vessels having a container bowl, a generally flat support base and an elongated stem extending therebetween, comprising;

a support panel having a top support surface with at least one aperture therein, said aperture including a chamfered peripheral edge forming a socket adapted to receive and retain the stem of an inverted stemmed vessel having its stem extending through the aperture with the support base thereof seated in said socket, an aperture access slot communicating with said aperture for permitting lateral insertion of a vessel stem into said aperture, a tray panel pivotally mounted on said top support surface for movement between a lowered position adapted to overlie and contact the support base of a vessel when seated in said socket for positive retention thereof and a raised position allowing access for removal thereof, and a a keeper mechanism for positively holding said tray panel in the lowered position.

14. The combination of claim 13 wherein; said keeper mechanism is connected to a top portion of the support panel and acting on a top portion of the tray panel for positively holding said tray panel in the lowered position.

15. The combination of claim 13 wherein the at least one aperture in said support surface has a center point and a peripheral edge to form a socket for receiving a base of an inverted stemmed vessel, and further comprising;

a non radial aperture access slot for permitting lateral insertion of a vessel stem into said aperture, the slot and aperture meeting at a junction, the slot having substantially parallel side edges and a centerline offset from the center point of said aperture at the junction thereof.

16. A combination stemmed vessel storage rack and serving tray comprising;

a support panel having a top support surface with at least one aperture therein for receiving and retaining a stem of an inverted stemmed vessel with the base thereof contacting said top surface;

said at least one aperture in said support surface having a center point and a peripheral chamfered edge to form a socket for reception of a base of an inverted stemmed vessel, a non radial aperture access slot communicating with said aperture for permitting lateral insertion of a vessel stem into said aperture, the slot and aperture meeting at a junction, the slot having substantially parallel side edges and a centerline offset from the center point of said aperture at the junction thereof, a tray panel pivotally mounted on said top support surface for movement between a lowered position overlying the base of the vessel for positive retention of said vessel and a raised position allowing access for removal thereof, and a a keeper mechanism for positively holding said tray panel in the lowered position.

17. The combination of claim 16 wherein said aperture and said chamfered edge are circular and one side of said slot is substantially tangent to said aperture.

18. The combination of claim 17 wherein;

said keeper mechanism is connecting to a top portion of the support panel and acting on a top portion of the tray panel for positively holding said tray panel in the lowered position.

19. The combination of claim 18 wherein;

said support surface includes a plurality of said apertures and associated access slots, said support panel having a free edge and at least one feeder slot opening therein, said access slots connecting with said feeder slot for reception of vessel stems via said free edge.

20. A combination stemmed vessel storage rack and serving tray comprising:

a support panel having a top support surface with a plurality of circular apertures therein each for receiving and retaining a stem of an inverted stemmed vessel with a base thereof contacting said top surface, said apertures each having a center point, an edge, and a peripheral circular chamfered edge to form a socket for reception of a base of an inverted stemmed vessel, said support panel having a free edge and at least one feeder slot opening therein for reception of vessel stems via said free edge;

a tray panel pivotally mounted on said top surface for movement between a lowered position overlying the base of the vessel for positive retention of said vessel and a raised position allowing access for removal thereof, the tray panel extending beyond said free edge to facilitate raising a lowering;

an plurality of aperture access slots connecting with said feeder slot, each access slot associated with an aperture, for permitting lateral insertion of a vessel stem into said apertures, the slots having a longitudinal axis offset from the center point of said aperture and having a side that is substantially tangent to the aperture; and a keeper mechanism acting between said support panel and said tray panel for positively holding said tray panel in the lower position.

21. A combination stemmed vessel storage rack and serving tray comprising:

a support panel having peripheral edges and a top support surface with at least one circular apertures therein for receiving and retaining a stem of an inverted stemmed vessel with a base thereof contacting said top surface, said aperture having a center point, an edge, and a peripheral circular chamfered edge to form a socket for reception of a base of an inverted stemmed vessel, said support panel having a free edge;

a tray panel pivotally mounted on said top surface for movement between a lowered position overlying the base of the vessel for positive retention of said vessel and a raised position allowing access for removal thereof;

an aperture access slot for permitting lateral insertion of a vessel stem into said aperture, the slot having a longitudinal axis offset from the center point of said aperture and having a side that is substantially tangent to the aperture;

vertical side and end walls connected to the peripheral edges of said support panel except for said free edge, said vertical side and end walls having bottom edges, said walls elevating said support surface a predetermined distance above an underlying horizontal support member to accommodate stemmed vessels depending therefrom and;

a plurality of storage openings in said support surface located adjacent the peripheral edges thereof except said free edge, and a shelf structure connected to said side and end walls beneath said support panel to receive items inserted into said storage openings.

22. The combination of claim 21 including means on said end or side walls for connecting said storage rack to a vertical wall surface.

23. The combination according to claim 21 further including;

a bottom wall panel connected to the bottom edges of said side and end walls forming a secondary storage area, and handle means on said end walls for hand carrying said storage rack.

24. In a stemmed vessel retention rack having a support surface, a vessel support structure comprising;

at least one aperture in said support surface having a center point and a peripheral edge forming a socket for reception of a surface of a vessel having its stem extending through said aperture, a non radial aperture access slot communicating with said aperture for permitting lateral insertion of a vessel stem therein, the slot and the aperture meeting at a junction, the slot having substantially parallel side edges and a centerline offset from the center point of said aperture at the junction thereof, a tray panel pivotally mounted on said top said surface for movement between a lowered position overlying the base of the vessel for positive retention of said vessel and a raised position allowing access for removal thereof, and a a keeper mechanism for positively holding said tray panel in the lowered position.

25. A stemmed vessel retention rack comprising;

a substantially planar panel having a top support surface, at least one aperture in said panel adapted to contain a vessel stem, said aperture having a center point and a peripheral edge forming a socket for reception of a surface of a vessel having its stem extending through said aperture, a non radial access slot in said panel communicating in said aperture to permit lateral insertion of a vessel stem therein, the slot and the aperture meeting at a junction, the slot having substantially parallel side edges and a centerline offset from the center point of said aperture at the junction thereof, a tray panel pivotally mounted on said support surface for movement between a lowered position overlying the base of the vessel for positive retention of said vessel and a raised position allowing access for removal thereof, and a a keeper mechanism for positively holding said tray panel in the lowered position.

* * * * *

UNITED STATES PATENT AND TRADEMARK OFFICE

CERTIFICATE OF CORRECTION

PATENT NO. : 6,126,256
DATED : October 3, 2000
INVENTOR(S) : G. John Doces II

It is certified that error appears in the above-identified patent and that said Letters Patent is hereby corrected as shown below:

Column 7,
Line 27, cancel "a"
Line 28, cancel "a"
Line 65, cancel "a"
Line 66, cancel "a"

Column 8,
Line 34, change "4" to read -- 11 --
Line 59, cancel "a"
Line 60, cancel "a"

Column 9,
Line 29, cancel "a"
Line 30, cancel "a"

Column 10,
Line 63, cancel "top said"
Line 67, cancel "a"

Column 11,
Line 1, cancel "a"
Line 10, change "in" second occurrence to -- with --

UNITED STATES PATENT AND TRADEMARK OFFICE

CERTIFICATE OF CORRECTION

PATENT NO. : 6,126,256
DATED : October 3, 2000
INVENTOR(S) : G. John Doces II

It is certified that error appears in the above-identified patent and that said Letters Patent is hereby corrected as shown below:

Column 12,
Line 8, cancel "a"
Line 9, cancel "a"

Signed and Sealed this

Thirtieth Day of October, 2001

*Attest:*

Nicholas P. Godici

NICHOLAS P. GODICI
*Acting Director of the United States Patent and Trademark Office*

*Attesting Officer*